US005449300A

United States Patent [19]

Yoon

[11] Patent Number: 5,449,300

[45] Date of Patent: Sep. 12, 1995

[54] CONNECTION TERMINAL ASSEMBLY HAVING ELASTICALLY MOUNTED WIRE CONTACTING PLATES

[76] Inventor: Heung S. Yoon, #102-810 Daewoo Apartment, No. 70, Ahnyang-2dong, Ahnyang-shi, Kyoungkido, Rep. of Korea

[21] Appl. No.: 101,423

[22] Filed: Aug. 3, 1993

[30] Foreign Application Priority Data

Feb. 18, 1993 [KR] Rep. of Korea ..... 1993-2206

[51] Int. Cl.[6] ..... H01R 4/24

[52] U.S. Cl. ..... 439/441; 439/218

[58] Field of Search ..... 439/438–441, 439/409–413, 717, 217, 218, 220, 221

[56] References Cited

U.S. PATENT DOCUMENTS

| | | | |
|---|---|---|---|
| 2,720,634 | 10/1955 | Hart | 439/441 |
| 3,119,647 | 1/1964 | Flagg | 439/441 |
| 3,907,392 | 9/1975 | Haag et al. | 439/218 |
| 3,955,869 | 5/1976 | Licht | 439/218 |
| 4,759,726 | 7/1988 | Naylor et al. | 439/441 |
| 5,062,024 | 10/1991 | Hennemann | 439/717 |

*Primary Examiner*—David L. Pirlot

*Attorney, Agent, or Firm*—Whitham, Curtis, Whitham & McGinn

[57] ABSTRACT

This invention relates to a connection terminal assembly constructed by forming recesses at four corners of one side, hinge shafts and fixed shafts at its opposite side of where said recesses are located, and an opening; installing a wire contacting plate elastically by using a spring which is inserted in an inclined hole; and forming guide grooves at one side of the connection terminal assembly so that a "T" type conductor plate or a "Z" type conductor plate can be selectively fed into said guide grooves. A wire inserted into an opening is pressed firmly by a wire contacting plate which is elastically mounted by a spring and rotates around a hinge shaft.

4 Claims, 5 Drawing Sheets

CONNECTION TERMINAL ASSEMBLY HAVING ELASTICALLY MOUNTED WIRE CONTACTING PLATES

BACKGROUND OF THE INVENTION

The present invention relates to a connection terminal assembly that can press a wire inserted through an opening between the lower portion of a wire contacting plate, which is elastically mounted by a spring on a hinge shaft, and a conductor plate.

Various types of connection terminals were used in the past, but those in the prior arts required a tool like a screwdriver which could tighten a wire fastening bolt when wire connecting was carried out. Thus it was very difficult and inconvenient to tighten the bolt. Further, when shock or vibration was applied externally to the connection terminal, the wire fastening bolt was readily loosened, and tight and firm connection of the wire for a desired time period could not be achieved.

Also, in the past, to eliminate problems in the above wire fastening bolt, there were connection terminal assemblies which use a wire contacting plate of high elasticity. By using a highly elastic plate to fix the wire firmly, it was possible to prevent the wire from being withdrawn by shock or vibration. However, it required a material of high quality structure which had elasticity strong enough to maintain the wire connection. Moreover, when connecting or withdrawing the wire, a force stronger than the elasticity inherent in the plate was required to open the plate, thus making the operation difficult and inefficient.

It is the object of this invention to solve these problems of prior arts.

SUMMARY OF THE INVENTION

In this invention, a wire contacting plate, which is elastically mounted by a spring through an open side of the connection terminal assembly, and a conductor plate are simply constructed in a connection terminal assembly. The number of the connection terminal assembly to be assembled can be adjusted to facilitate wire connecting operation.

DETAILED DESCRIPTION OF THE INVENTION

The structure, operational method, and effects of this invention are explained in detail below with reference to the accompanying drawings.

Figure 5:
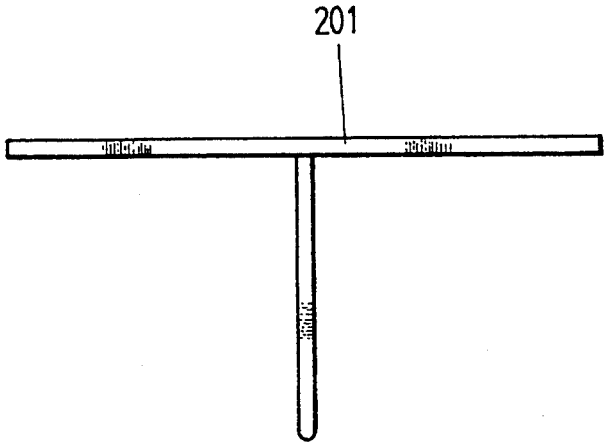
FIG. 5 is a view of the "T" type conductor member used for mounting the assembly to a printed circuit board in a vertical orientation.
Figure 6:
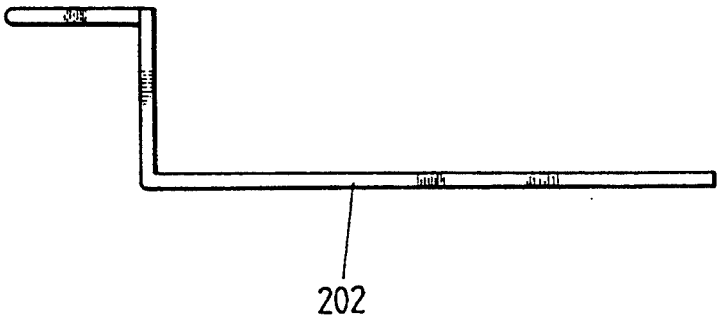
FIG. 6 is a view of the "Z" type conductor member used for mounting the assembly to a printed circuit board in a horizontal orientation.

The present invention is constructed by mounting a wire contacting plate (102) with a small recess (103) on a hinge shaft (4) of the connection terminal assembly which has recesses (5) at four corners of one side, hinge shafts (4) and fixed shafts (4') at the opposite side of where said recesses (5) are located so that they can be inserted into said recesses (5), and an opening (2); installing said wire contacting plate (102) elastically by using a spring (101) which is inserted in an inclined hole (6); and forming guide grooves (7)(8) at one side of the connection terminal assembly so that a "T" type conductor plate (201) or a "Z" type conductor plate (202) is selectively fed into said guide grooves (7) (8). The "T" type conductor member (201) and the "Z" type conductor member (202) are best illustrated in FIGS. 5 and 6, respectively.

Non-explained reference numerals 3 is a fixed jaw, 9 is a cover member, 300 is the wire, 400 is the P.C.B. (printed circuit board), and 401 is the soldered portion.

Figure 1:
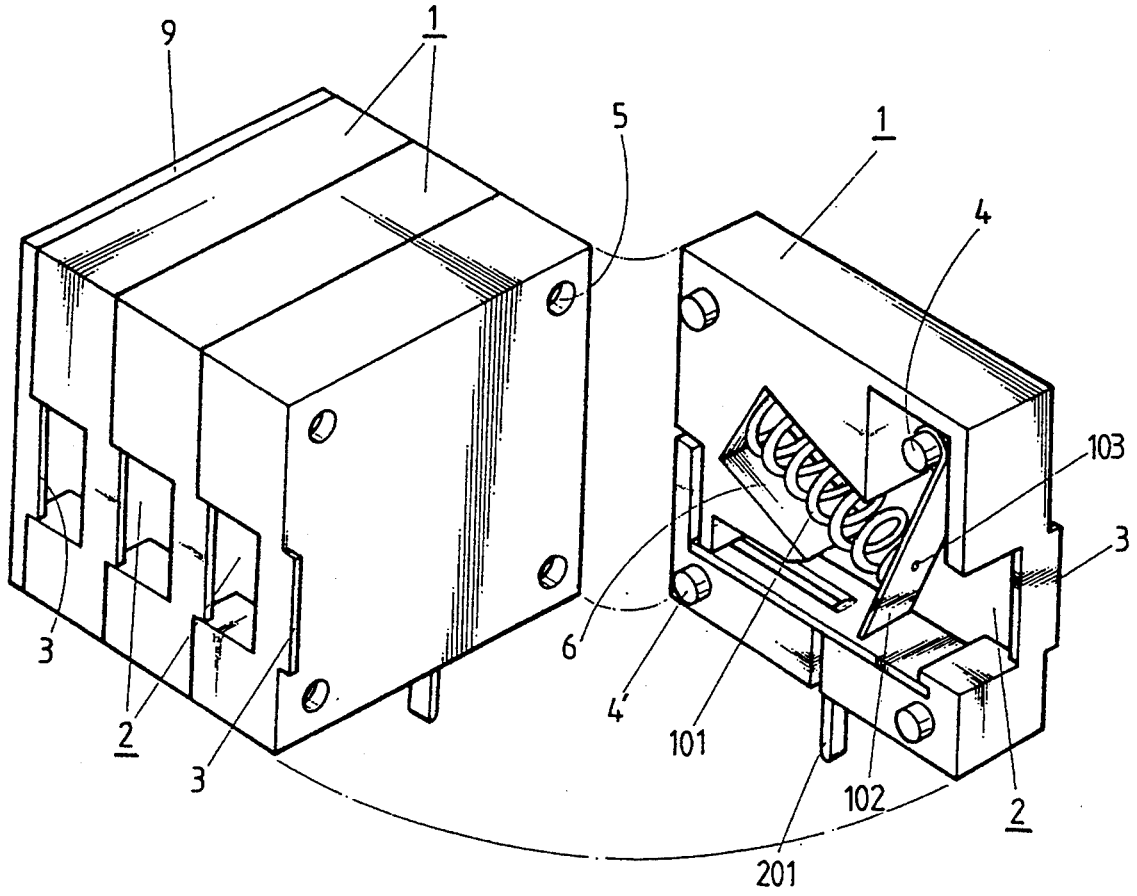
FIG. 1 is a perspective view of the assembled connection terminal showing a part of its inner composition.
Figure 2A:
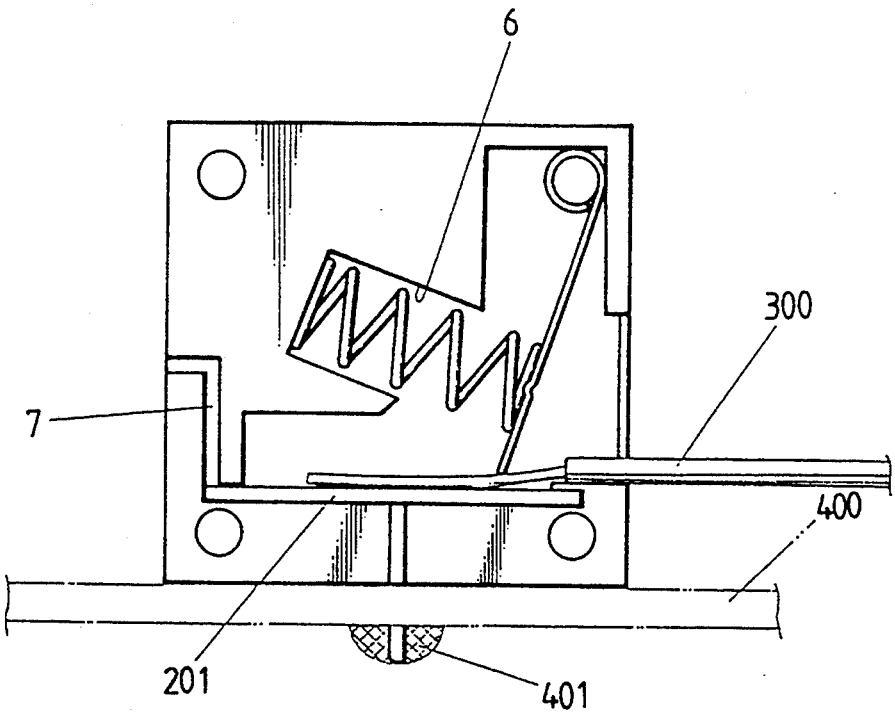
FIG. 2A is a side view of the connection terminal showing the wire inserted under a wire contacting plate and pressed between the wire contacting plate, moving widely around the hinge shaft, and the conductor plate.
Figure 3:
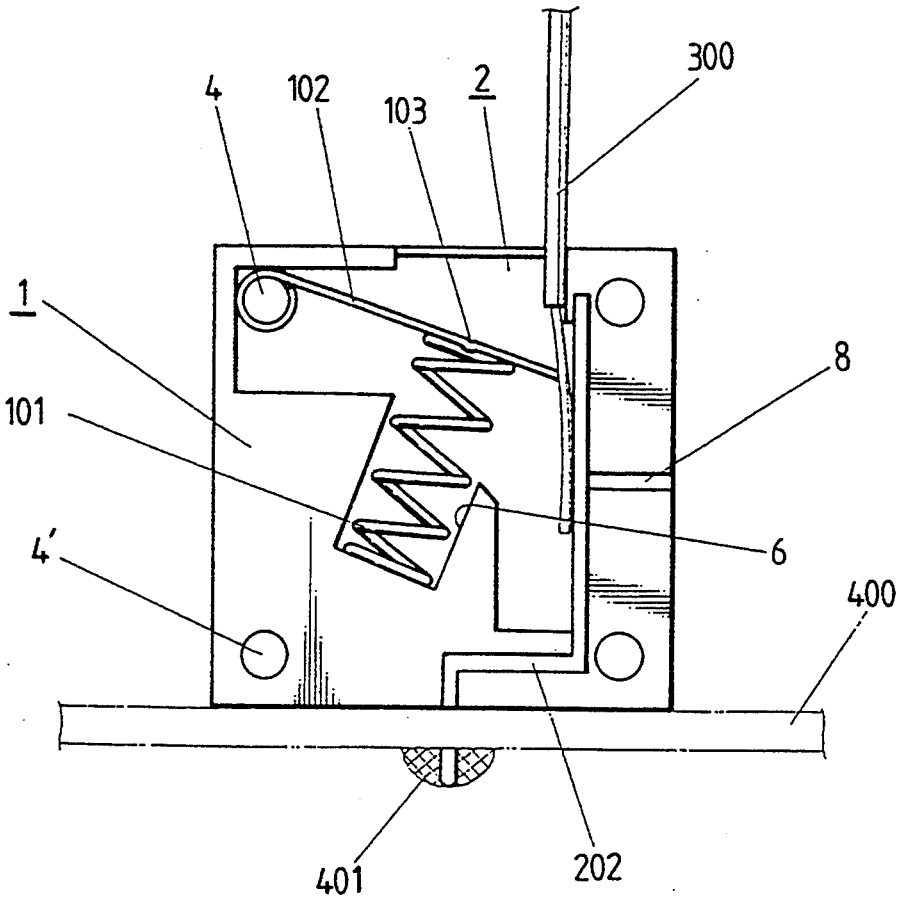
FIG. 3 is a side view of the connection terminal, the opening of the housing of which is directed upward by installing a "Z" type conductor plate to its housing which is attached to the P.C.B. (printed circuit board).
Figure 4:
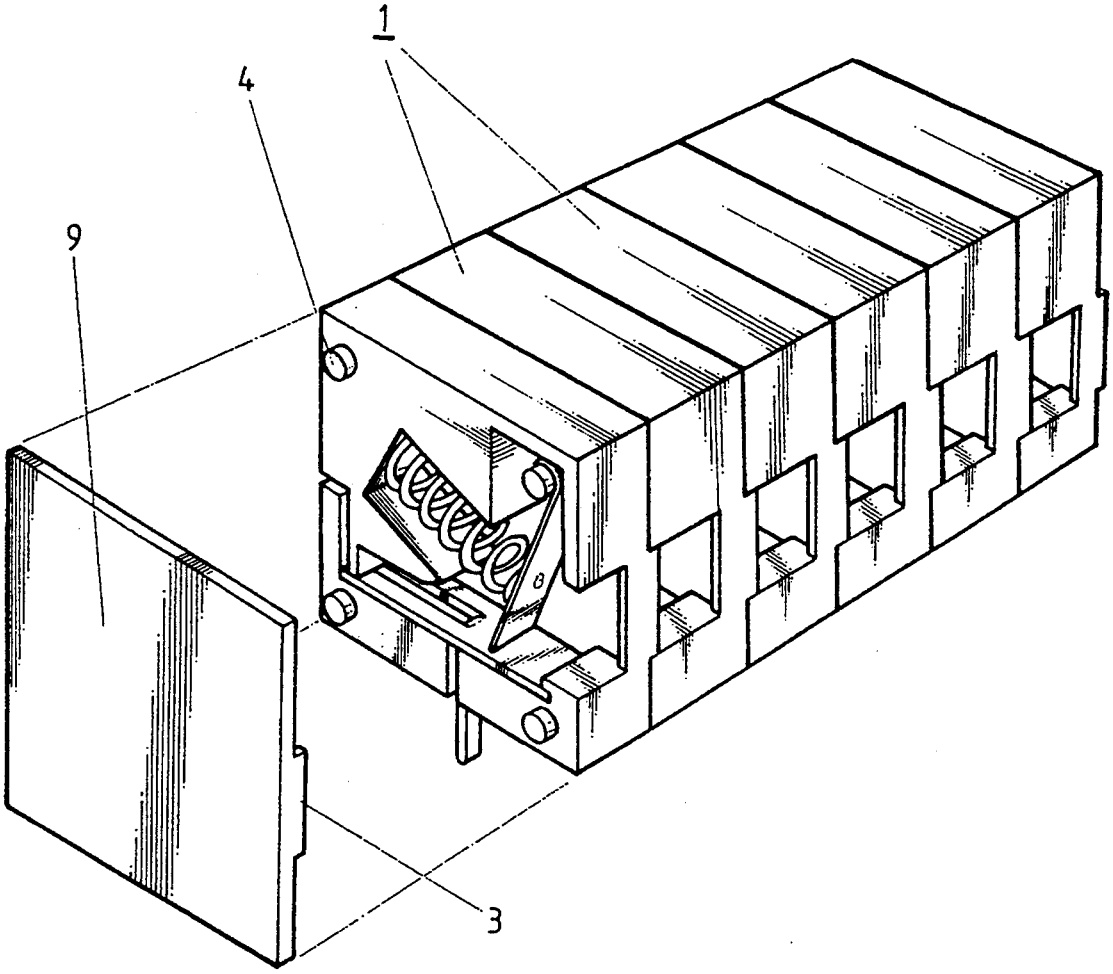
FIG. 4 is a perspective view of the embodiment showing its inner composition and its entire assembled mode when the cover is open.

As described in the above, the connection terminal assembly (1) can be adjusted to a proper size according to the capacity to be used. Therefore, it is possible to vary its uses. Because the combination state between the recesses (5) and the hinge shaft (4) and fixed shaft (4') to be inserted therein is very solid, there is no danger of disintegration or vibration during its use, and thus it can be used in an elaborate wiring operation. When connecting the wire with its clad end portion stripped off (300) to the connection terminal assembly (1) mounted on a typical P.C.B. (400), an interval can be formed by pushing the lower portion of the wire contacting plate (102), which is elastically mounted on the hinge shaft (4) by a spring (101), with the end portion of the wire (300), and thus by lifting the end portion of the wire contacting plate, which is pushed inwardly around the hinge shaft (4), from the "T" type conductor (201) or the "Z" type conductor (202). Thus the wire (300) is inserted through the lower portion of the wire contacting plate (Refer to FIGS. 2A and 3). Once the wire (300) is inserted, it is pressed by the elastically mounted plate (102) by a spring (101) and becomes difficult to be withdrawn. Furthermore, if an external force of opposite direction to the direction of insertion is applied to the wire, the wire contacting plate (102) stops at the contact line (of the lower portion of the wire contacting plate, conductor plate and wire) and does not rotate any further, because the wire contacting plate (102), which rotates around the hinge shaft (4), can not rotate toward the conductor plate which is located within the radius of rotation. Because of this characteristic in its structure, the wire (300) pressed between the lower portion of the wire contacting plate (102) and the conductor plate is tightly fixed in a pressed state.

Figure 2B:
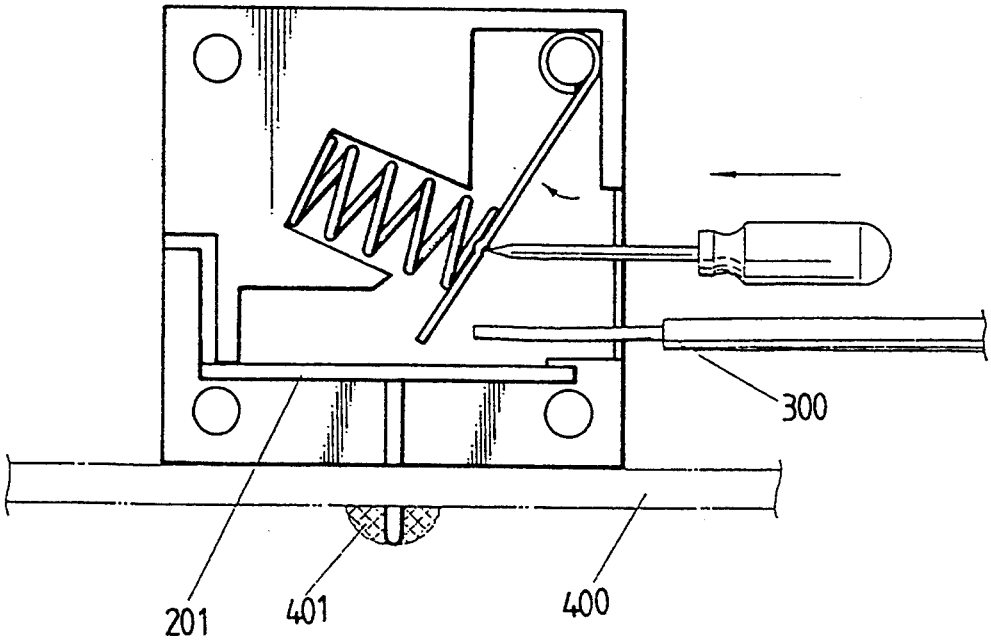
FIG. 2B is a side view of the connection terminal showing that the wire pressed between the lower portion of the wire contacting plate and the conduction plate can be withdrawn by pushing inwardly said wire contacting plate.

When withdrawing the wire (300) from the wire contacting plate (102), as shown in FIG. 2B, a wide interval is formed between the wire contacting plate (102) and the conduction plate (201) (202) by pushing the wire contacting plate (102) inwardly with a tool, and thus the wire (300) pressed under the lower portion of the wire contacting plate (102) can be readily withdrawn.

The connection terminal assembly (1) of the present invention described in the above is efficient, simple, and convenient in many ways: the wire (300) is tightly pressed at the lower portion of the wire contacting plate (102) elastically mounted by a spring (101) when it is lightly inserted through an opening (2) of the connection terminal assembly without using a tool; the wire (300) once pressed at the lower portion of the wire contacting plate (102) is not withdrawn or vibrated by any external impact; rather, if the wire (300) is pulled outwardly or is subject to any shock or vibration, it is pressed more strongly by the elasticity of a spring (101) and the structure itself; moreover, in turning an opening (2) of the connection terminal assembly (1) mounted on the P.C.B. (400) upward or sideward according to its use, it is possible to mount selectively a "T" type conductor plate (201) or a "Z" type conductor plage (202) to the two types of the guide grooves (7)(8) which are formed at the connection terminal assembly (1), and to choose the direction of said opening (2). Consequently, the present invention enables diversification of the use of the connection terminal assembly (1), elimination of problems and inconveniences in wiring operation, and supplement of solidity in wire connecting operation.

What is claimed is:

1. A dual-orientation wire connection terminal assembly for a printed circuit board, comprising:

a housing having a receptacle located on a sidewall adapted to receive a wire;

a conductor member having a first portion positioned along the floor of said receptacle and adapted to contact the wire along ills length;

grooves channeled in said housing for holding said conductor member, said grooves defining a first exit in a sidewall of said housing adjacent said receptacle and a second exit in a sidewall opposite said receptacle;

a plate hinged above said first portion of said conductor member, said plate adapted to swing in a direction away from said receptacle;

a spring means connected to said housing and to said plate for keeping said plate hinged in a closed position to lock the wire between said plate and said first portion of said conductor member; and a second portion of said conductor member adapted to be secured to a printed circuit board, said second portion projecting from said first exit if said wire connection terminal assembly is to have a horizontal orientation or from said second exit if said wire connection terminal assembly is to have a vertical orientation.

2. A dual-orientation wire connection terminal assembly as recited in claim 1 wherein said conductor member is a "T" shape if said wire connection terminal assembly has a vertical orientation.

3. A dual-orientation wire connection terminal assembly as recited in claim 1 wherein said conductor member is a "Z" shape if said wire connection terminal assembly has a horizontal orientation.

4. A dual-orientation wire connection terminal assembly as recited in claim 1 wherein the wire is released by pushing said plate against said spring.

* * * * *